US006019242A

United States Patent [19]

Wysocki et al.

[11] Patent Number: 6,019,242

[45] Date of Patent: Feb. 1, 2000

[54] MULTI-COMPARTMENT CONTAINER AND LID THEREFOR

[75] Inventors: Edward H. Wysocki, Kentwood, Mich.; Richard T. Williams, Clarendon, Ill.

[73] Assignees: Cascade Engineering, Inc., Grand Rapids, Mich.; Waste Management, Inc., Oak Brook, Ill.

[21] Appl. No.: 09/151,451

[22] Filed: Sep. 11, 1998

Related U.S. Application Data

[60] Provisional application No. 60/058,628, Sep. 11, 1997.

[51] Int. Cl.[7] ..... B65D 51/04

[52] U.S. Cl. ..... 220/571; 220/524; 220/909; 220/DIG. 6

[58] Field of Search ..... 220/571, 524, 220/909, DIG. 6

[56] References Cited

U.S. PATENT DOCUMENTS

| | | | |
|---|---|---|---|
| D. 343,490 | 1/1994 | Ramsey . | |
| 5,063,563 | 7/1991 | Mezey . | |
| 5,088,616 | 2/1992 | Susuko et al. | 220/909 |
| 5,129,535 | 7/1992 | Hradisky . | |
| 5,129,543 | 7/1992 | White . | |
| 5,171,119 | 12/1992 | Carson . | |
| 5,184,751 | 2/1993 | Middleton | 220/571 |
| 5,303,841 | 4/1994 | Mezey . | |
| 5,316,174 | 5/1994 | Schutz | 220/571 |
| 5,373,961 | 12/1994 | Harris et al. | 220/571 |
| 5,647,412 | 7/1997 | Brewer | 220/571 |
| 5,662,235 | 9/1997 | Nieto | 220/909 |
| 5,878,881 | 3/1999 | Hunt | 220/571 |

*Primary Examiner*—Joseph M. Moy
*Attorney, Agent, or Firm*—Rader, Fishman & Grauer PLLC

[57] ABSTRACT

A waste container having a hingedly mounted lid that can be moved between a closed position for covering the container to an open position for providing access to the container. The lid is provided with a groove spaced from the hinge so that when the lid is rotated from the closed position to the open position, any moisture on the lid will flow into the groove where it is directed off of the lid instead of onto the hinge or into the waste container.

20 Claims, 2 Drawing Sheets

MULTI-COMPARTMENT CONTAINER AND LID THEREFOR

RELATED APPLICATION

This application claims the benefit of United States Provisional patent application Ser. No. 60/058,628, filed Sep. 11, 1997.

BACKGROUND OF THE INVENTION

1. Field of the Invention

This invention relates to containers with lids, and more particularly to a lid construction for multi-compartment containers.

2. Description of the Related Art

Waste material or refuse which comprises a number of recyclable components such as aluminum cans, glass, paper, etc., have conventionally been collected as a conglomerate and disposed of in a landfill. It has been the practice of some individuals, communities and waste management companies to separate the recyclable components from the nonrecyclables and place them in separate containers depending on their composition. However, emptying the separate containers into separate bins or compartments in a refuse truck or other collection device is time consuming and labor intensive. Such systems also require a number of containers for each home owner which can impose a prohibitive capital investment on a refuse collection agency or home owner. In addition, the separate containers occupy more space than desired and each must be manually transported to a collection location, such as a curb or alley way on a regular basis for pick-up.

In an attempt to overcome these problems, several containers have been developed with two or more compartments and a separate lid for each compartment. In one container, a pair of lids is attached to a central partition through a common hinge arrangement and are pivotal toward each other for access to the compartments. In one type of hinge arrangement, an elongate pin pivotally interconnects steel hinge plates that are mounted to each lid and the central portion such that the lids can rotate with respect to the partition. One disadvantage associated with this arrangement is that the hinge components are subject to rust. Another disadvantage is that any water remaining on the lid tops will run toward the hinge assembly and leak into the container when the lids are opened. In another arrangement, the lids and partition are formed of a polymeric material and each has molded projections which fit with each other to form an aligned row of such projections. An axial opening through each projection receives a steel or plastic pivot rod to rotatably mount the lids to the partition. Although this, type of hinge arrangement is not subject to rust, water leakage into the container through the hinge is still a problem.

SUMMARY OF THE INVENTION

The water runoff problems and disadvantages of the prior waste container and waste container lid is addressed according to the invention by a closable waste container comprising a bottom wall from which extends a peripheral wall that terminates in a peripheral edge, defining a waste container with an open top. A lid with an upper surface is bounded by an inner edge and a perimeteral edge. The lid is hingedly mounted at the inner edge to the peripheral wall and is movable between a closed position and an open position. In the closed position, the lid substantially covers the container open top. In the open position, the lid is removed from the container open top. The lid upper surface has a groove with opposing ends and which extends between two portions of the perimeteral edge. The groove is shaped so that any moisture on the lid upper surface between the groove and the perimeteral edge will run into the groove and flow out at least one of the opposing ends without contacting the lid inner edge as the lid is rotated from the closed to open position.

Preferably, the waste container comprises multiple compartments formed by a divider wall positioned within the waste container and extending between the portions of peripheral wall to divide the waste container into a first receptacle and a second receptacle, both of which have open tops. A lid is provided for each receptacle and the inner edge of each lid is hingedly mounted to the divider wall.

One of the opposing ends can be spaced farther from the inner edge than the other opposing end. However, it is preferred that a portion of the groove intermediate the opposing ends is spaced farther from the inner edge than both opposing ends. The groove can have a partial elliptical shape whose apogee forms the intermediate portion or a shape of two intersecting straight portions whose intersection forms the intermediate portion. The intermediate portion is preferably located equidistant between the opposing ends.

Preferably, the lid upper surface is rectangular with opposing side edges connected by end edges and the inner edge is defined by one of the side edges and the perimeteral edge is defined by the other of the side edges and the end edges. The groove can extend between the side edges to transect the perimeteral edge, resulting in the opposing groove end being located at the corresponding side edges.

Further, in accordance with the invention, a lid for a closable waste container comprises an open-top receptacle housing defined by a peripheral wall on which is provided a hinge for hingedly mounting a lid for movement between a closed position where the lid substantially covers the open top and the open position where the lid is removed from the open top. The lid comprises an upper surface that is bounded by an inner edge and a perimeteral edge with the inner edge adapted to mount the hinge. A groove with opposing ends extends across the upper surface of the lid, transecting portions of the perimeteral edge. The groove is shaped so that any moisture on the lid upper surface between the groove and the peripheral edge will run into the groove and flow out at least one of the opposing ends as the lid is raised from its closed to its open position.

BRIEF DESCRIPTION OF THE DRAWINGS

The invention will now be described with reference to the drawings in which.

DETAILED DESCRIPTION

Figure 1:
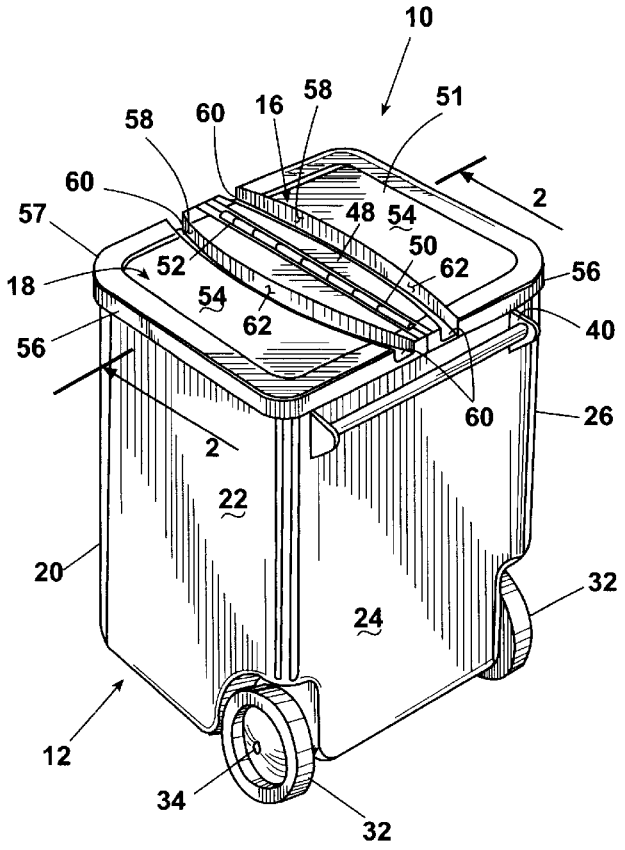
FIG. 1 is a perspective view of a divided refuse container assembly according to the invention.
Figure 2:
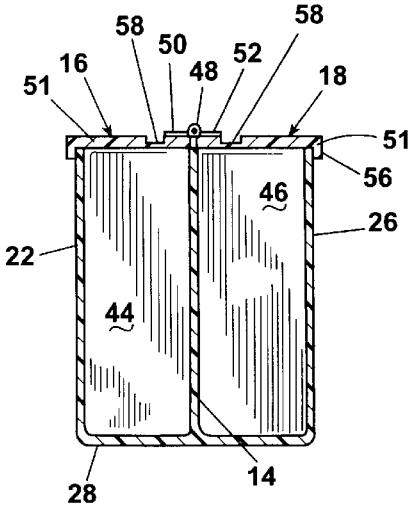
FIG. 2 is a sectional view of the container assembly taken along line 2—2 of FIG. 1.
Figure 3:
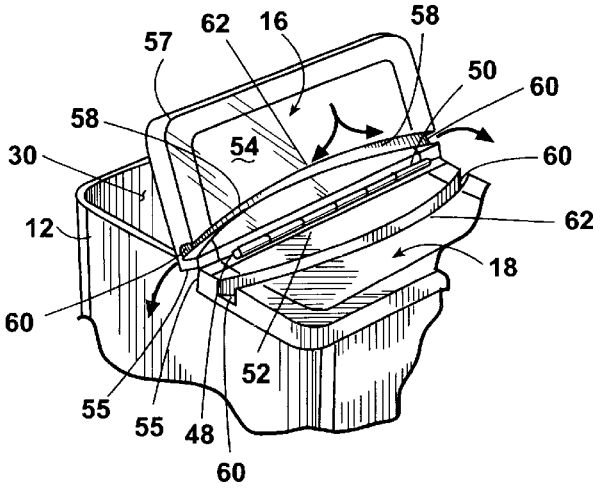
FIG. 3 is a perspective view of a portion of the container assembly of FIG. 1 with one of the lids partially raised.

Referring now to FIGS. 1—3, a divided container assembly 10 comprises a container 12, a partition 14, and a pair of lids 16, 18 pivotally connected to the partition. The container 12 includes a peripheral wall formed by side walls 20, 22, 24, and 26 extending from a generally flat bottom 28. The upper edges of the side walls define a peripheral edge that defines an open upper end 30. The container may be generally circular in cross section or may be generally rectangular as shown. A pair of wheels 32 can be mounted to the container 12 through an axle 34 that extends through apertures 36 (only one of which is shown in FIG. 2) in a lower portion of the shell. A handle 40 extends outwardly from an upper portion of the side wall 24 to assist in transporting and lifting the container.

The partition 14 is integrally formed with the container and extends from the side wall 24 to the side wall 28 to transect the peripheral edge and upwardly from the bottom 28 to the opening 30. The partition 14 divides the container into a first or left side compartment 44 that may be designated for disposables and a second or right side compartment 46 that may be designated for recyclables, such as metal, glass, plastics, etc. Alternatively, the compartments may be designated for two different types of recyclables. The container, partition and lids are preferably formed of a light weight and durable material, such as glass fiber reinforced polyethylene or polypropylene.

A hinge 48 is mounted to the upper end of the partition 14 and extends between the side walls 24, 28. The hinge 48 is shown as being of the piano type having a first hinge plate 50 attached to the lid 16 and a second opposite hinge plate 52 attached to the lid 18. In the closed position, the lids 16 and 18 cover the compartments 44 and 46, respectively, to keep out moisture, scavenging animals, and reduce odor. Both of the lids 16, 18 pivot upward toward the center of the container to provide access to their respective compartments.

Each lid 16, 18 has a generally planar portion with an upper surface 54 bound by an inner edge 55 and a perimeteral edge 57, connecting the ends of the inner edge 55. The inner edge 55 is connected to the corresponding hinge plate 50. A rim 56 extends around the perimeteral edge of each lid 16, 18 to strengthen the lid and provide a barrier against moisture. A curved channel 58 is formed inwardly from an upper surface 54 of each lid and preferably extends across the entire width of each lid to transect the lid. The ends 60 of the channel 58 are spaced at a first distance from the hinge 48 while a middle section 62, intermediate the ends of the channel, is spaced at a second distance therefrom. Preferably, the second distance is greater than the first distance such that any water that may be present on the lid upper surface due to rain, dew, sprinklers, etc., flows under gravity into the channel 58 and out the ends 60 of the channel as illustrated by arrows in FIG. 3, to thereby prevent the water from entering the container through the hinge 48 when the lid is rotated open. The channel 58 as shown in FIG. 2 is trapezoidal in cross section, but may be of any desired cross section, such as rectangular, curved, etc.

Figure 4:
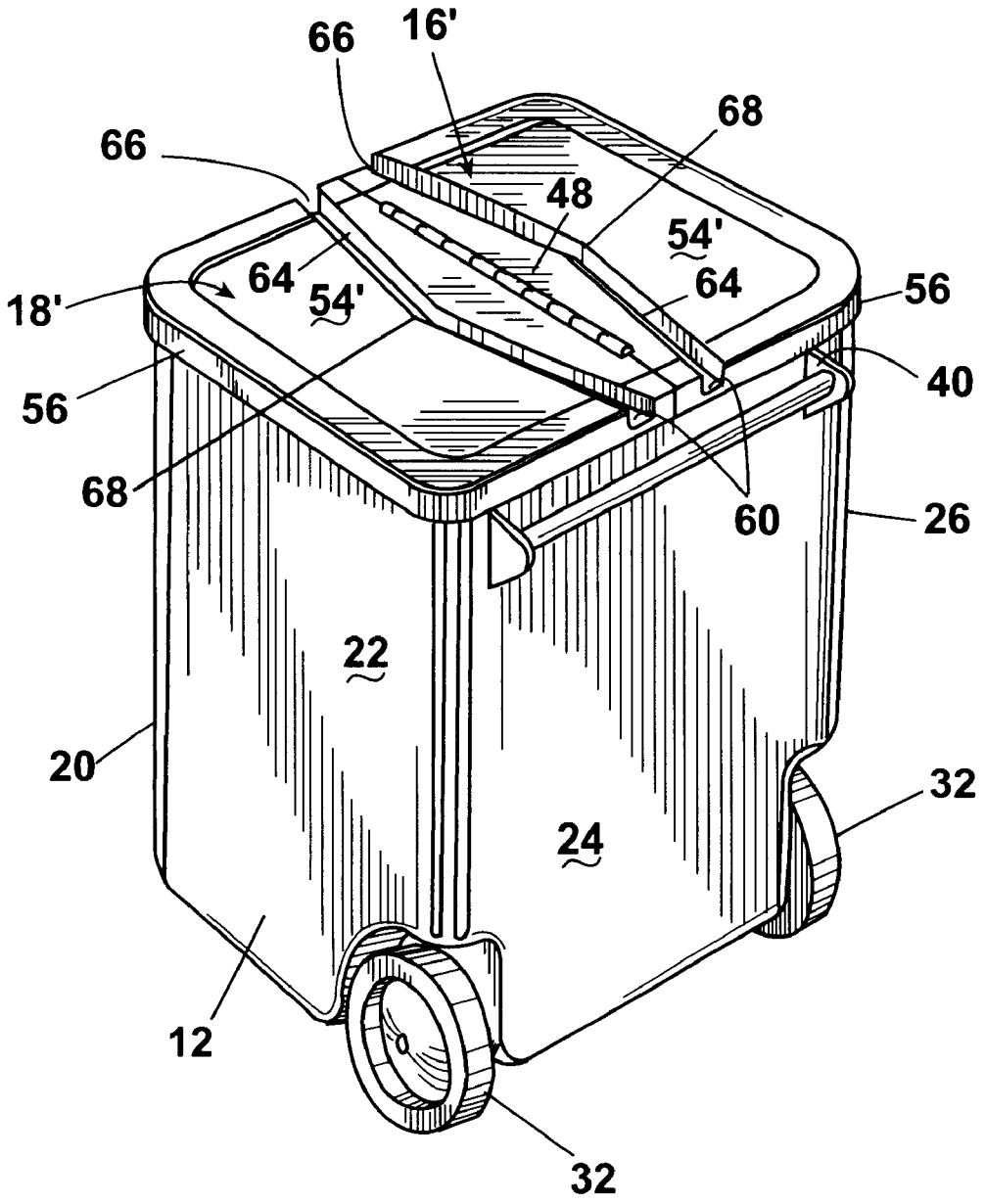
FIG. 4 is a perspective view of a divided refuse container and lid assembly according to a second embodiment of the invention.

With reference now to FIG. 4, a second embodiment of a container lid is shown, wherein like parts in the previous embodiment are represented by like numerals. In this embodiment, a first lid 16' is attached to the hinge plate 50 while a second lid 18' is attached to the hinge plate 52 of the hinge 48. As in the previous embodiment, a rim 56 extends around the outer peripheral edge of each lid 16, 18 to strengthen the lid and provide a barrier against moisture. A V-shaped channel 64 is formed inwardly from an upper surface 54' of each lid and preferably extends across the entire width of each lid. The ends 66 of each channel 64 are spaced at a first distance from the hinge 48 while an apex 68 of the V-shaped channel is spaced at a second distance from the hinge. Thus, when the lid is rotated open, any water that may be present on the lid upper surface 54' flows under gravity into the channel 64 and out of the ends 66 to thereby prevent the water from entering the container through the hinge 48.

It is preferred that both channel ends are closer to the hinge edge of the lid than a portion of the channel intermediate of the ends. It is also preferred that the intermediate portion be located generally equidistant from the ends because the water on the lid will be equally diverted in two directions, reducing the likelihood of water overflowing the channel. However, for the invention to function, it is only necessary that one portion of the channel be farther away from the lid hinge edge than at least one of the ends; such as, for example, the channel could be straight with one end higher than the other end.

Whereas the invention has been described with reference to lid constructions for divided refuse carts, the invention can also be used for other divided containers and for undivided containers.

Reasonable variation and modification are possible within the spirit of the foregoing specification and drawings without departing from the scope of the invention.

What is claimed is:

1. A closable waste container comprising:

a bottom wall;

a peripheral wall extending upwardly from the bottom wall and terminating in a peripheral edge to define a waste container with an open top;

a divider wall positioned within the waste container and transecting the peripheral wall to divide the waste container into a first receptacle with an open top and a second receptacle with an open top;

first and second lids each having an upper surface bounded by an inner edge and a perimeteral edge, each of the lids being hingedly mounted to the divider wall at the inner edge thereof, and each lid being moveable between a closed position where the first lid substantially covers the first receptacle open top and the second lid substantially covers the second receptacle open top and an open position where the first and second lids are removed from their respective receptacle open tops; and a groove in each lid upper surface extending across the lid between two portions of the perimeteral edge to transect the upper surface, the groove is shaped so that any moisture on the lid upper surface between the groove and the perimeters edge will run into the groove and flow out at least one of the opposing ends without contacting the lid inner edge when the lid is raised from its closed to its open position.

2. A closable waste container according to claim 1 wherein the at least one opposing end is closer to the inner edge than the other opposing end.

3. A closable waste container according to claim 1 wherein the a portion of the groove intermediate the opposing ends is spaced farther from the inner edge than both of the opposing ends.

4. A closable waste container according to claim 3 wherein the groove has a partial elliptical shape with an apogee that forms the intermediate portion.

5. A closable waste container according to claim 3 wherein the groove has a shape comprising two intersecting straight portions and their intersection forms the intermediate portion.

6. A closable waste container according to claim 3 wherein the intermediate portion is equidistant between the opposing ends.

7. A closable waste container according to claim 1 wherein each lid upper surface is rectangular with opposing side edges connected by end edges and the inner edge is defined by one of the side edges and the perimeteral edge is defined by the end edges and the other of the side edges.

8. A closable waste container according to claim 7 wherein each groove extends between the side edges to transect the upper surface and the opposing groove ends are located at the opposing side edges.

9. A closable waste container according to claim 8 wherein a portion of the groove intermediate the opposing ends is spaced farther from the inner edge than both opposing ends.

10. A closable waste container according to claim 9 wherein the intermediate portion is equidistant between the opposing ends.

11. A lid for a closable waste container comprising an open-top receptacle housing defined by a peripheral wall on which is provided a hinge for hingedly mounting the lid for movement between a closed position where the lid substantially covers the open top and an open position where the lid is removed from the open top, the lid comprising:

an upper surface bounded by an inner edge and a perimeteral edge with the inner edge adapted to mount to a hinge; and a groove with opposing ends is provided in the upper surface and extends between two portions of the perimeteral edge to transect the upper surface and the groove is shaped so that any moisture on the lid upper surface between the groove and the perimeteral edge will run into the groove and flow out the at least one of the opposing ends without contacting the lid inner edge as the lid is moved from the closed to the open position.

12. A closable waste container according to claim 11 wherein the at least one end is closer to the inner edge than the other opposing end.

13. A closable waste container according to claim 12 wherein a portion of the groove intermediate the opposing ends is spaced farther from the inner edge than both of the opposing ends.

14. A closable waste container according to claim 13 wherein the intermediate portion is equidistant between the opposing ends.

15. A lid according to claim 11 wherein each lid upper surface is rectangular with opposing side edges connected by end edges and the inner edge is defined by one of the side edges and the perimeteral edge is defined by the end edges and the other of the side edges.

16. A closable waste container according to claim 15 wherein each groove extends between the side edges to transect the upper surface and the opposing groove ends are located at the opposing side edges.

17. A closable waste container according to claim 16 wherein a portion of the groove intermediate the opposing ends is spaced farther from the inner edge than both opposing ends.

18. A closable waste container according to claim 17 wherein the intermediate portion is equidistant between the opposing ends.

19. A closable waste container comprising:

a bottom wall;

a peripheral wall extending upwardly from the bottom wall and terminating in a peripheral edge to define a waste container with an open top;

a lid having an upper surface bounded by a hinge edge and a perimeteral edge, the lid being hingedly mounted to a portion of the peripheral wall at the hinge edge, and the lid being moveable between a closed position where the lid substantially covers the first receptacle open top and an open position where the first lid does not substantially cover the first receptacle open top; and a groove in the lid upper surface, the groove having opposing ends and extending between two portions of the perimeteral edge to transect the upper surface, and the groove is shaped so that any moisture on the lid upper surface between the groove and the perimeteral edge will run into the groove and flow out at least one of the opposing ends without contacting the lid inner edge as the lid is moved between the closed and open position.

20. A closable waste container according to claim 19 and further comprising:

a divider wall positioned within the waste container and extending between two portions of the peripheral wall to divide the waste container into a first receptacle with an open top and a second receptacle with an open top;

a second lid having an upper surface bounded by a hinge edge and a perimeteral edge, the lid being moveable between a closed position where the lid substantially covers the first receptacle open top and an open position where the first lid is removed from the first receptacle open top, and a groove in the lid upper surface, the groove having opposing ends and extending between two portions of the perimeters edge; and wherein the hinge edge of each lid is hingedly mounted to the divider wall.

* * * * *